US008714696B2

(12) United States Patent
Tanaka

(10) Patent No.: US 8,714,696 B2
(45) Date of Patent: May 6, 2014

(54) LIQUID COLLECTION DEVICE AND LIQUID EJECTING APPARATUS

(75) Inventor: Takeshi Tanaka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 13/217,164

(22) Filed: Aug. 24, 2011

(65) Prior Publication Data

US 2012/0050399 A1 Mar. 1, 2012

(30) Foreign Application Priority Data

Aug. 25, 2010 (JP) ..... 2010-187958
Jun. 13, 2011 (JP) ..... 2011-130981

(51) Int. Cl.
*B41J 2/165* (2006.01)

(52) U.S. Cl.
USPC ..... 347/30; 347/25

(58) Field of Classification Search
USPC ..... 347/22, 23, 25, 29, 30
See application file for complete search history.

(56) References Cited

U.S. PATENT DOCUMENTS

2006/0017770 A1 1/2006 Harada et al.
2007/0252864 A1 11/2007 Uchino

FOREIGN PATENT DOCUMENTS

JP 2006-218846 8/2006
JP 2007-296757 11/2007

*Primary Examiner* — Lamson Nguyen
(74) *Attorney, Agent, or Firm* — Workman Nydegger

(57) ABSTRACT

A liquid collection device includes a liquid ejecting head that ejects liquid, a suction-delivery unit that sucks the liquid from the liquid ejecting head and delivers the sucked liquid, a liquid collection unit that collects the liquid delivered from the suction-delivery unit, and a gas delivery unit that delivers gas to the liquid collection unit.

10 Claims, 7 Drawing Sheets

LIQUID COLLECTION DEVICE AND LIQUID EJECTING APPARATUS

BACKGROUND

1. Technical Field

The present invention relates to a liquid collection device and a liquid ejecting apparatus including the liquid collection device.

2. Related Art

An ink jet printer (hereinafter called "printer") has been known for some time as one type of a liquid ejecting apparatus that ejects liquid onto a target. In the printer, cleaning operation that discharges ink with increased viscosity and the like from nozzles through which ink is ejected is carried out so as to reduce failure in ink ejection. In the cleaning operation, a nozzle forming-face in which the nozzles are formed is covered with a cap, thereafter a suction pump carries out suction operation in a cap space formed by the nozzle forming-face and the cap so that ink is discharged from the nozzles.

The ink discharged from the nozzles (hereinafter referred to as "waste ink") is collected in a waste ink tank. The waste ink tank includes a liquid collection container and an ink absorber (liquid absorber) held in the liquid collection container. The waste ink discharged into the waste ink tank is absorbed by the ink absorber.

The waste ink permeates into the ink absorber. These days, as the number of nozzles is likely to increase so as to boost printing speed, the amount of waste ink is consequently increased. With the increase in waste ink, the volume of the ink absorber also increases. This causes a problem such that ink does not permeate into the entire ink absorber. The problem is not only due to a large volume of the ink absorber but also due to a phenomenon in which an ink solvent evaporates during a permeation process of ink so that the ink becomes to have difficulty in permeating into the absorber.

Configurations that suppress evaporation of an ink solvent using such liquid collection container have been proposed so far (for example, see JP-A-2006-218846). In a liquid collection container described in JP-A-2006-218846, a discharge opening for waste ink and an ink absorbing member (ink absorber) disposed in the vicinity of the discharge opening are covered by a cover member so that a solvent component of ink that has been discharged into the liquid collection container is suppressed from evaporating, thereby quickening diffusion of the waste ink into the inside of the ink absorbing member.

However, with the liquid collection container described in JP-A-2006-218846, although permeation capability is enhanced through suppressing the evaporation of an ink solvent, the permeation capacity of waste ink into an ink absorbing member is limited.

Even if an ink absorbing member having an enough size to absorb a required amount of waste ink is provided, the waste ink does not permeate through the entire ink absorbing member in the case where the size of the ink absorbing member is beyond the permeation capability. As a result, waste ink stays stagnantly in part of the ink absorbing member. Accordingly, there has been a risk such that the staying waste ink leaks out from an opening portion of the liquid collection container in the case where, for example, the printer is tilted.

SUMMARY

An advantage of some aspects of the invention is to provide a liquid collection device and a liquid ejecting apparatus including the liquid collection device. In the liquid collection device, liquid (for example, waste ink) discharged into a liquid collection container is made to permeate and be absorbed into the entirety of a liquid absorber (for example, ink absorbing member).

The invention is intended to solve at least one of the aforementioned problems and can realize the following aspects.

A liquid collection device according to an aspect of the invention is a liquid collection device that includes a liquid ejecting head that ejects liquid, a suction-delivery unit that sucks the liquid from the liquid ejecting head and delivers the sucked liquid, and a liquid collection unit that collects the liquid delivered from the suction-delivery unit. It is preferable that the liquid collection device further include a gas delivery unit that delivers gas into the liquid collection unit.

With the liquid collection device in such configuration, liquid sucked and delivered from the liquid ejecting head is collected in the liquid collection unit. By delivering gas to the liquid collection unit and diffusing the liquid with pressure of the gas which has been delivered, the liquid is collected in a state in which the liquid is diffused across the entire liquid collection unit.

In the liquid collection device according to another aspect of the invention, it is preferable that the liquid collection unit include a first connection portion that connects with the suction-delivery unit and a second connection portion that connects with the gas delivery unit.

According to such configuration, as the suction-delivery unit that delivers liquid and the gas delivery unit that delivers gas are separately disposed, pressure to the liquid in delivery and pressure to the gas in delivery can be changed. This makes it possible to set a delivery pressure of gas so that the liquid is diffused across the entire liquid collection unit.

In the liquid collection device according to another aspect of the invention, it is preferable that the liquid collection unit include a liquid absorber that absorbs the liquid and a liquid collection container that holds the liquid absorber, and the liquid collection container include the first connection portion, the second connection portion, and an opening portion that exposes the liquid absorber. Further, it is preferable that a liquid discharge portion that discharges the liquid into the liquid collection unit and a gas discharge portion that discharges the gas into the liquid collection unit be disposed at one end side in the horizontal direction of the liquid collection unit, and the opening portion be disposed at the other end side in the horizontal direction of the liquid collection unit.

According to such configuration, the liquid discharge portion and the gas discharge portion are disposed at one end side in the horizontal direction of the liquid collection container, and the opening portion of the liquid collection container is disposed at the other end side in the horizontal direction of the liquid collection container, whereby the liquid discharge and gas discharge portions are positioned being separated from the opening portion in the horizontal direction. Liquid has difficulty in permeating in the horizontal direction inside the liquid absorber, but is likely to permeate in the gravitational direction. By separating the gas discharge portion from the opening portion in the horizontal direction, the discharged gas flows toward the opening portion and the liquid permeates also toward the opening portion driven by the pressure of gas. This causes liquid to permeate in the horizontal direction, although liquid inherently has difficulty in permeating in the horizontal direction, and consequently makes it possible for liquid to permeate into the entire liquid absorber.

In the liquid collection device according to another aspect of the invention, it is preferable that the liquid collection unit include a space portion formed by the liquid collection container and the liquid absorber, the liquid be discharged from the liquid discharge portion into the space portion, and the gas be discharged from the gas discharge portion into the space portion as well.

According to such configuration, by discharging liquid and gas into the space portion, the space portion becomes a receiving portion that receives the liquid and the gas as well. This makes it possible to directly apply the pressure of gas to the space portion and effectively make use of the pressure of gas.

In the liquid collection device according to another aspect of the invention, it is preferable that the space portion be configured of one single space.

According to such configuration, in the case where the space portion is configured of one single space, the space that receives discharged liquid becomes large. Accordingly, the entire liquid absorber making contact with the space becomes a portion that receives the liquid. This makes it possible to receive the liquid with a larger area.

In the liquid collection device according to another aspect of the invention, it is preferable that the space portion be formed respectively corresponding to the liquid discharge portion and the gas discharge portion, and the gas discharge portion be disposed at a lower position than the liquid discharge portion in the gravitational direction.

According to such configuration, in the case where the space portions are formed respectively corresponding to the liquid discharge portion and the gas discharge portion, a portion to which liquid is discharged and a portion to which pressure of gas is applied are different from each other. In this case, pressure of gas is applied to liquid that has been discharged from the liquid discharge portion and has permeated into the liquid absorber in a diffusion state due to the gravity, and the pressure of gas is applied to the liquid by the gas discharge portion that is disposed at a lower position than the liquid discharge portion in the gravitational direction. As a result, the discharged liquid can be made to permeate and diffuse across the entire liquid absorber because the pressure of gas can be applied to a wide range of the liquid absorber.

A liquid ejecting apparatus according to an aspect of the invention, it is preferable that a liquid ejection apparatus include the liquid collection device described above.

According to such liquid ejecting apparatus, since the apparatus includes the aforementioned liquid collection device, it is possible to suppress clogging in the liquid absorber and cause the liquid that has been discharged into the liquid collection container to permeate into the inside of the liquid absorber.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

An embodiment of a liquid collection device according to the invention and a liquid ejecting apparatus including the liquid collection device is described below taking an ink jet printer as an example with reference to the drawings.

In the following descriptions, "front-rear direction," "upward-downward direction" and "right-left direction" are, unless otherwise noted, identical to "front-rear direction," "upward-downward direction" and "right-left direction" described in FIG. 1 as reference directions. In this embodiment, the upward-downward direction corresponds to the gravitational direction, whereas the right-left direction corresponds to the horizontal direction.

Figure 1:
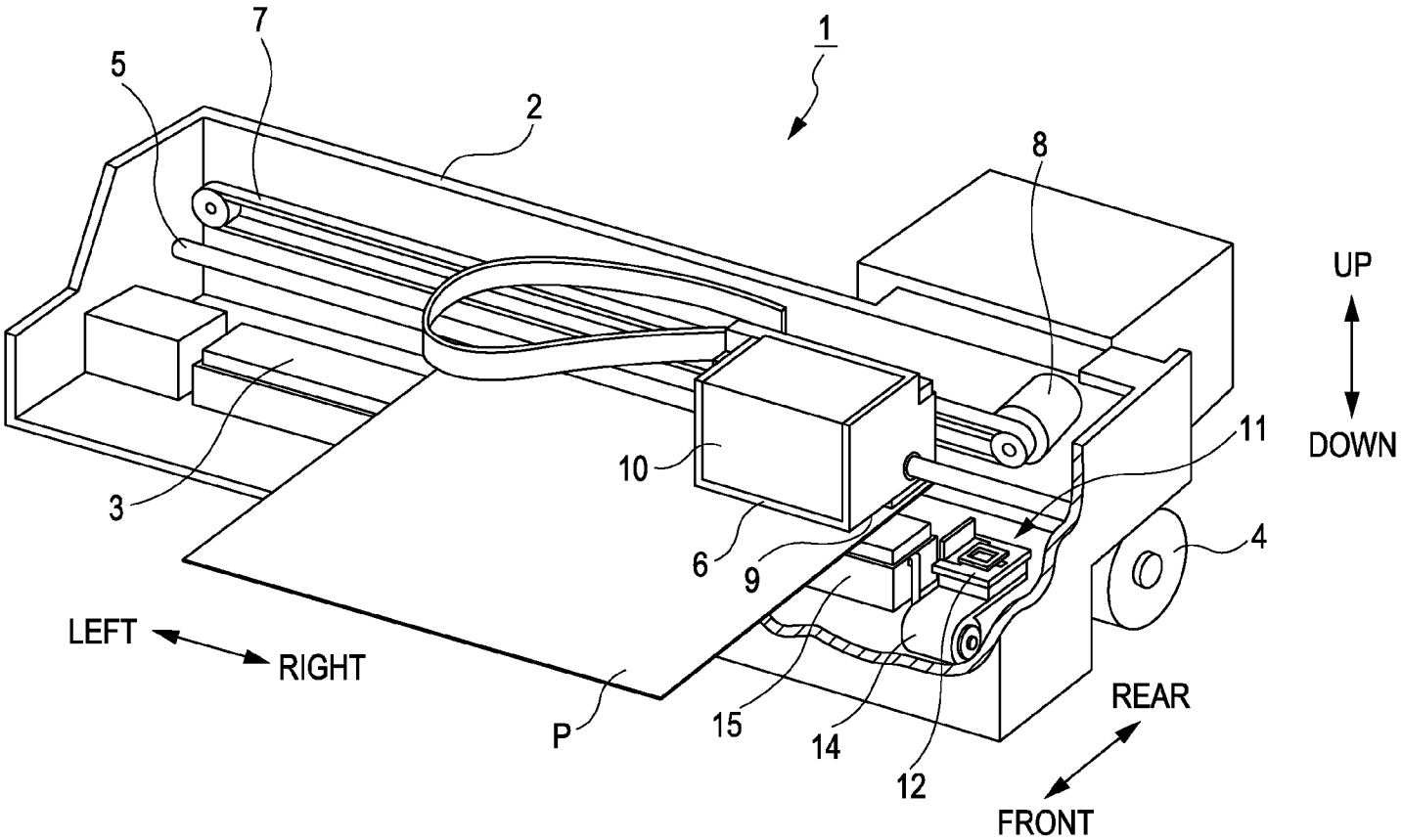
FIG. 1 is a perspective view of an ink jet printer according to a first embodiment of the invention.

As shown in FIG. 1, an ink jet printer 1 (hereinafter called "printer 1"), which is a type of a liquid ejecting apparatus, includes a frame 2. In the frame 2, a platen 3 is provided. A recording sheet P is transported onto the platen 3 by driving a paper feed motor 4. Further in the frame 2, a bar-shaped guide member 5 is provided in parallel to the lengthwise direction (right-left direction) of the platen 3.

On the guide member 5, a carriage 6 is supported so as to be capable of moving back and forth in an axial direction (right-left direction) of the guide member 5.

The carriage 6 is connected to a carriage motor 8 provided at a rear face in the frame 2 via a timing belt 7 provided at the rear face in the frame 2. Thus, the carriage 6 is caused to reciprocate along the guide member 5 by driving the carriage motor 8.

In the carriage 6, a recording head 9 as a liquid ejecting head is provided and an ink cartridge 10 that supplies ink as a liquid to the recording head 9 is detachably disposed. Ink in the cartridge 10 is supplied to the recording head 9 and ejected therefrom onto the recording sheet P which has been transported on the platen 3 so as to carry out printing.

A maintenance mechanism 11 as a liquid collection device that varies out cleaning and the like on the recording head 9 is provided in a non-print region (hereinafter, also called "home position region") located at one end side of the printer 1.

Figure 2:
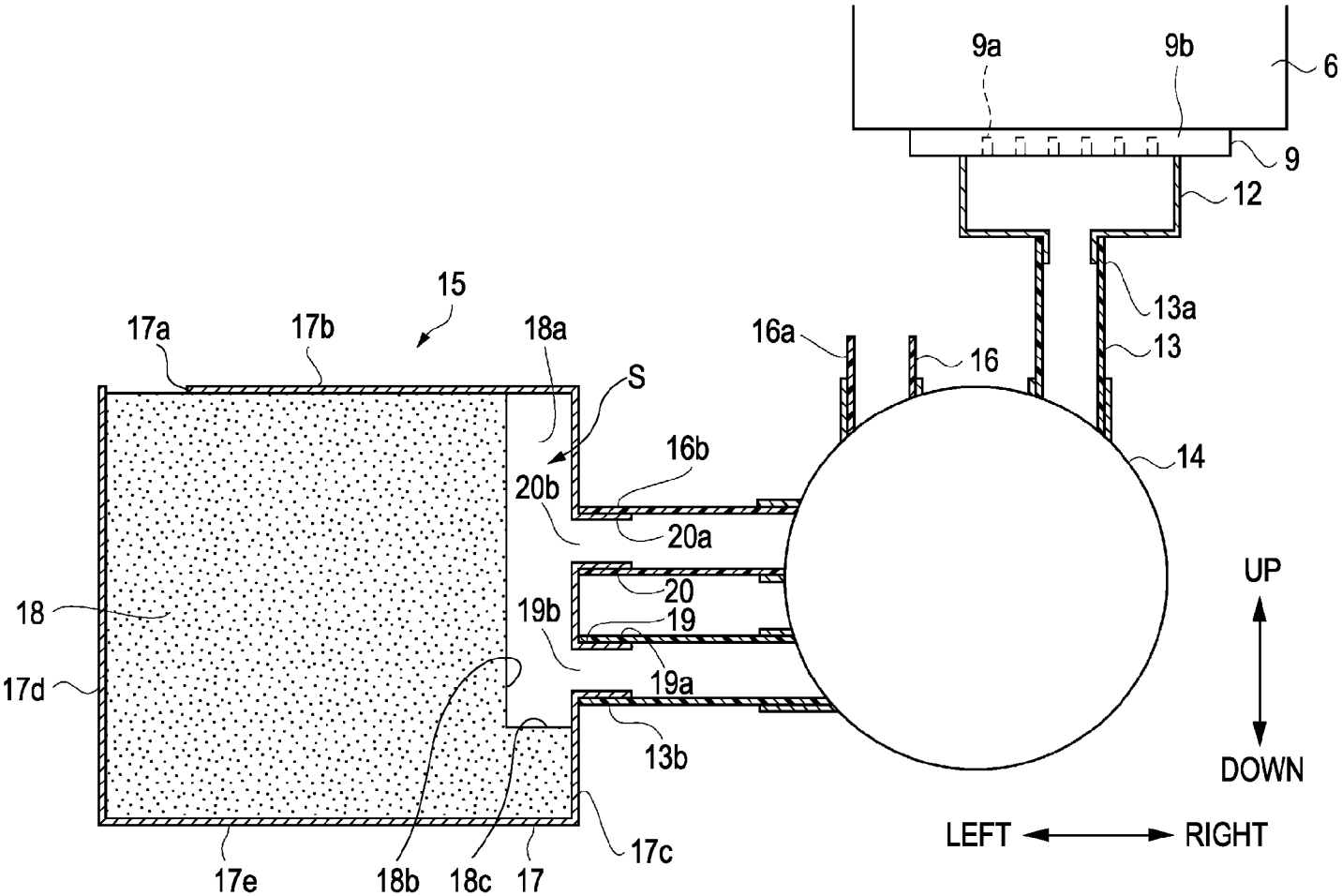
FIG. 2 is a schematic cross-sectional view of a maintenance mechanism of a printer.

As shown in FIG. 2, the maintenance mechanism 11 includes a cap 12, a tube 13, a pump 14, and a waste ink tank 15.

In the embodiment, a set of the cap 12, tube 13, and pump 14 corresponds to the suction-delivery unit.

The cap 12 is provided as a liquid receiver that receives waste ink which has been discharged or sucked from the recording head 9 by covering the recording head 9 during non-printing. A hole provided in the bottom of the cap 12 is connected with the tube 13 so that the cap 12 can deliver the waste ink.

The tube 13 is made of a flexible material (e.g., rubber or a resin such as elastomer). The tube 13 serves as a liquid delivery tube that delivers waste ink from the cap 12 to the waste ink tank 15, in which one end side (upstream side) 13*a* is connected to the cap 12 and the other end side (downstream side) 13*b* is connected to the waste ink tank 15. Note that the pump 14 is provided halfway in the tube 13.

The pump 14 is, for example, a tube pump, and sucks the ink (waste ink) discharged from the recording head 9 from the side of the cap 12 to deliver it to the side of the waste ink tank 15.

Figure 3:
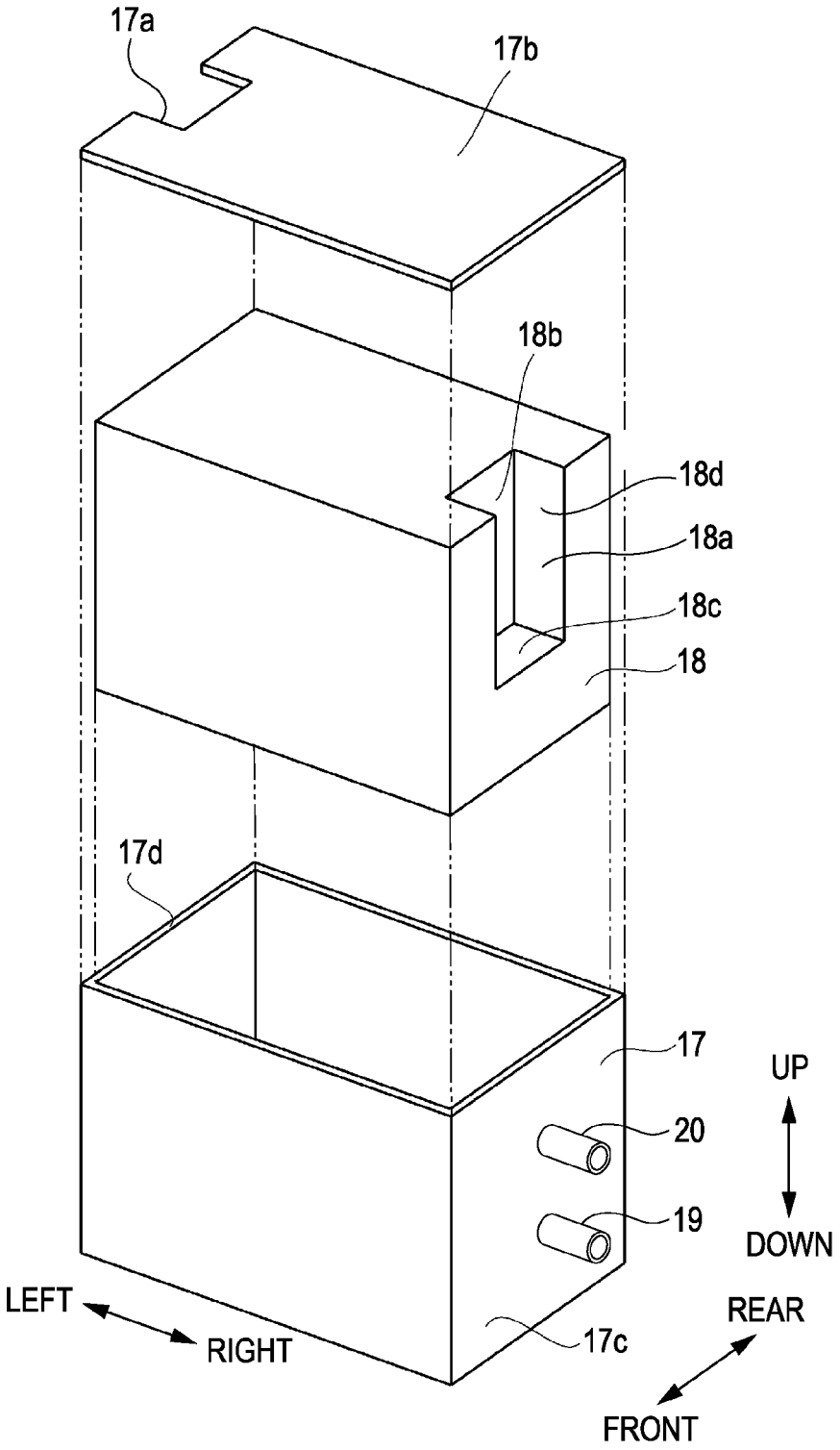
FIG. 3 is an exploded perspective view of a waste ink tank according to the first embodiment.

The waste tank 15 is a liquid collection unit, and includes a liquid collection container 17 formed in an approximately rectangular parallelepiped shape and a liquid absorber 18 held in the liquid collection container 17, as shown in FIGS. 2 and 3.

The liquid collection container 17 includes an upper wall 17*b*, a side wall 17*c*, another side wall 17*d*, and a bottom wall 17*e*. On the side wall 17*c* arranged upright in the liquid collection container 17, a first projection portion 19*a* and a second projection portion 20*a* which are projecting outward are formed.

Both the first projection portion 19*a* and second projection portion 20*a* are shaped in hollow cylinders, and hollow portions thereof pass through the inside of the liquid collection container 17 so as to communicate with exterior. The other end side 13*b* of the tube 13 is connected to the first projection portion 19*a* as a first connection portion 19. A tube 16 which is explained later is connected to the second projection portion 20*a* as a second connection portion 20.

The first projection portion 19*a* is disposed at a lower position than the second projection portion 20*a* (second connection portion 20) in the gravitational direction on the side wall 17*c*. A first opening portion 19*b* as a liquid discharge portion is formed at an end portion of the first projection portion 19*a* inside the liquid collection container 17. Therefore, waste ink which is delivered by the pump 14 is delivered from the first opening portion 19*b* into the liquid collection container 17 via the tube 13, and is absorbed by the liquid absorber 18.

The tube 16 is connected to the second projection portion 20*a*. Further, a second opening portion 20*b* as a gas discharge portion is formed at an end portion of the second projection portion 20*a* inside the liquid collection container 17.

The tube 16 is made of a flexible material (e.g., rubber or a resin such as elastomer). The tube 16 serves as a gas delivery tube that delivers gas (air) to the waste ink tank 15, in which one end side (upstream side) 16*a* is open to the air and the other end side (downstream side) 16*b* is connected to the second projection portion 20*a* of the waste ink tank 15. Note that the pump 14 is provided halfway in the tube 16.

Accordingly, by driving the pump 14, air is inhaled from the upstream side 16*a*, and discharged into the liquid collection container 17 from the second opening portion 20*b* via the tube 16.

The liquid absorber 18 is made of a material having good ink permeability and water retentivity, such as sponge, felt, unwoven cloth, pulp and the like. In the embodiment, the liquid absorber 18 is made of sponge, which is a porous material.

The liquid absorber 18 is shaped in an approximately rectangular parallelepiped along the inner surface of the liquid collection container 17, and has a recess portion 18*a* in part thereof.

Part of the liquid absorber 18 opposing the first opening portion 19*b* and the second opening portion 20*b* is cut out approximately in a rectangular parallelepiped shape to form the recess portion 18*a*. The liquid absorber 18 and the first opening portion 19*b* and second opening portion 20*b* are distanced from each other due to the recess portion 18*a* without making contact with each other.

As shown in FIG. 2, the recess portion 18*a* is cut out up to the upper face of the liquid absorber 18, and the recess portion 18*a* is covered with the upper wall 17*b* of the liquid collection container 17. Note that the lower side of the recess portion 18*a* is not cut out down to the lower face of the liquid absorber 18. The recess portion 18*a* is cut out until it comes to a position a little lower than the first opening portion 19*b* to form a face 18*c* of the cut liquid absorber 18.

As shown in FIG. 3, the recess portion 18*a* is formed by cutting out a center portion of the liquid absorber 18 in the front-rear direction on the side of the side wall 17*c*, so as to be surrounded by side faces 18*b*, 18*d* and the face 18*c*.

Figure 7:
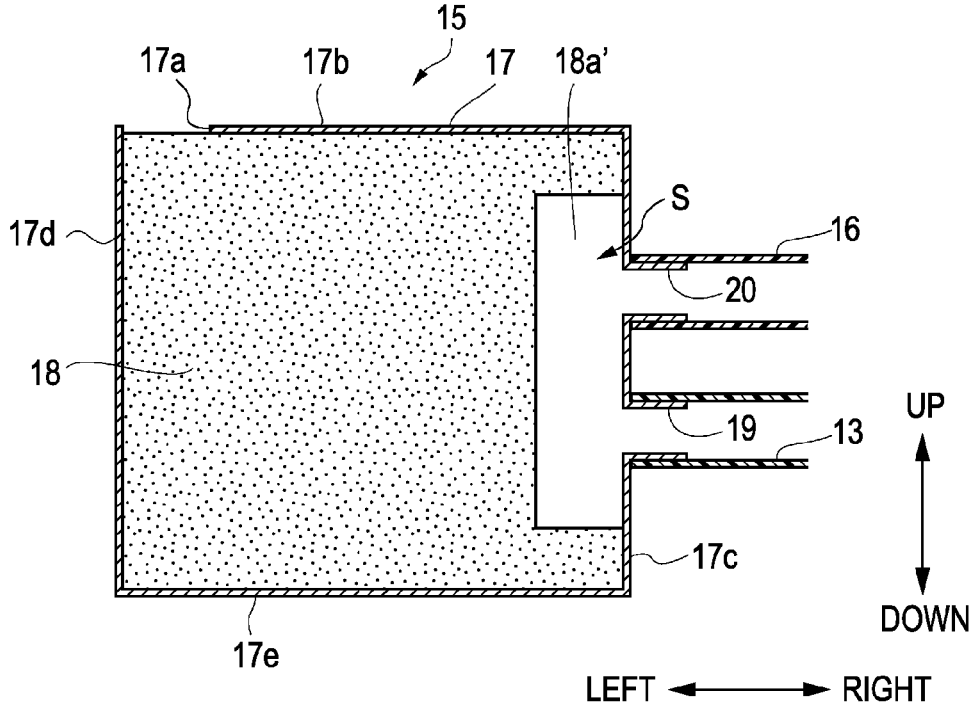
FIG. 7 is a cross-sectional view of a variation of a waste ink tank.

As a variation on the recess portion 18*a*, a recess portion 18*a*' may be provided such that the upper side does not necessarily need to be cut out up to the upper face of the liquid absorber 18 as illustrated in FIG. 7. Note that the lower side may be cut out down to the lower face of the liquid absorber 18. As for the front-rear direction, the cutting may be carried out from one side face of the liquid absorber 18 to the other opposing side face.

In the liquid collection container 17, a space S is formed by the recess portion 18*a*, the side wall 17*c*, and the upper wall 17*b* of the liquid collection container 17.

In the above-mentioned variation on the recess portion 18*a*, the space S is formed by the recess portion 18*a*' and the side wall 17*c* as illustrated in FIG. 7.

Waste ink discharged from the tube 13 and air (gas) discharged from the tube 16 are both discharged to the space S.

Part of the waste ink that has been discharged from the tube 13 and discharged to the space S through the first opening portion 19*b* is absorbed at the side faces 18*b* and 18*d* forming the recess portion 18*a*; the rest of the waste ink moves downward in the space S due to the gravity, and is absorbed at the face 18*c* of the liquid absorber 18 located on a lower side of the space S in the gravitational direction. In other words, the side faces 18*b*, 18*d* and the face 18*c* of the liquid absorber 18 enclosing the space S are ink receiving faces (ink receivers) that receive the waste ink.

Air delivered by the pump 14 is discharged from the tube 16, and is further discharged into the space S through the second opening portion 20*b*. Since the space S is a closed space, the space S is pressurized when air is discharged thereinto.

The liquid collection container 17 has the first opening portion 19*b* and the second opening portion 20*b* disposed in the side wall 17*c* which is one end side in the right-left direction (horizontal direction). Further, the container includes a third opening portion 17*a* as an opening portion in an upper portion at the other end side which is distanced from the side wall 17*c* of the space S in the right-lift direction (horizontal direction).

The third opening portion 17*a* is opened in the upper wall 17*b* so that the liquid absorber 18 is exposed.

Therefore, air discharged into the space S from the second opening portion 20*b* proceeds toward the third opening portion 17*a* from the space S. In other words, air pressure acts in a direction to which the space S is distanced.

Accordingly, waste ink discharged from the first opening portion 19*b*, while receiving pressure of the air that is discharged from the second opening portion 20*b*, also proceeds from the space S toward the third opening portion 17*a*. To rephrase, waste ink diffuses and permeates in the direction to which the space S is distanced.

In the embodiment, the third opening portion 17*a* is formed in a position which is higher than the positions of the first opening portion 19*b* and second opening position 20*b*, and is distanced from the first opening portion 19*b* and second opening portion 20*b* in the horizontal direction. Further, the third opening portion 17*a* is formed in the upper wall 17*b*, which encloses the liquid collection container 17, on the side of the side wall 17*d* opposite to the side wall 17*c* in which the first opening portion 19*b* and second opening portion 20*b* are provided, so that an opening is made between the upper wall 17*b* and the side wall 17*d*.

As the third opening portion 17*a* is distanced from the space S, the upper portion of the space S, the liquid absorber 18 from the space S to the third opening portion 17*a*, and the like are in a state in which they are covered with the upper wall 17*b*. Therefore, there hardly exists a risk such that air discharged into the liquid collection container 17 leaks out of the liquid collection container 17 from a portion other than the third opening portion 17*a*. This makes it possible to spread air across the whole liquid collection container 17 and cause waste ink to permeate into the entire liquid absorber 18.

Furthermore, since the upper portion of the space S, the liquid absorber 18 from the space S to the third opening portion 17*a*, and the like are covered by the upper wall 17*b* by making contact therewith, evaporation of a solvent component of the waste ink which has been discharged and absorbed can be suppressed. This makes it possible to suppress solidification and clogging of waste ink in the liquid absorber 18 in the vicinity of the space S. In addition, since ink permeates into the liquid absorber 18 more easily in a state where a solvent component of the ink being not evaporated, the permeation of waste ink into the inside of the liquid absorber 18 can further be boosted by suppressing the ink solidification with the discharged air.

Part of the solvent of the waste ink absorbed in the solid absorber 18 evaporates, and the evaporated solvent gas is discharged from the third opening portion 17*a*. This makes it possible to reduce the amount of waste ink absorbed and held in the liquid absorber 18, and consequently discharge much more waste ink into the liquid absorber 18.

It is to be noted that in the liquid collection container 17, the position where the third opening portion 17*a* is formed is not limited to the position mentioned above, and can be selectively determined depending on the shape of the liquid collection container 17, the disposition of the waste ink tank 15 in the printer 1, or the like. For example, the third opening portion 17*a* may be formed in the vicinity of the upper end portion of the side wall 17*d* or the opening portions may be provided in both the upper wall 17*b* and the side wall 17*d*.

Further, the size of the third opening portion 17*a* can be similarly determined depending on the shape of the liquid collection container 17, the amount of air discharged via the tube 16 into the liquid collection container 17. For example, the third opening portion 17*a* can be made larger if the amount of discharged gas is larger, or made smaller if the amount of discharged gas is smaller.

The size of the third opening portion 17*a* may be determined considering an amount of the waste ink that evaporates from the third opening portion 17*a*. The third opening portion 17*a* can be made as desired; for example, it may be made smaller if the evaporation amount is needed to be suppressed, or made larger if the evaporation amount is needed to be increased.

Note that in order to prevent the air, which has just been discharged from the tube 16, from leaking out to exterior, it is desirable that the third opening portion 17*a* is provided to a side in the direction which is distanced from the side wall 17*c* (side of the side wall 17*d* opposite to the side wall 17*c*).

In the embodiment, the second opening portion 20*b* is disposed in the side wall 17*c* at a higher position than the first opening portion 19*b* in the gravitational direction. Accordingly, there hardly exists a risk such that the waste ink discharged from the first opening portion 19*b* into the space S flows mistakenly into the tube 16 through the second opening portion 20*b* and leaks out to exterior when the waste ink moves in the space S.

Next, operations of the maintenance mechanism 11 are described below.

In the case where cleaning of the recording head 9 is carried out, at first, in a state in which the carriage 6 is moved to an upper portion of the maintenance mechanism 11 in the home position region, the cap 12 is elevated by a lifting-lowering device (not shown) so as to cover the recording head 9 (nozzle-forming face 9*a*) with the cap 12. Subsequently, the pump 14 is started up. This processing generates a negative pressure in the cap 12, whereby ink in each nozzle 9*b* of the recording head 9 is sucked due to the negative pressure. The sucked ink is discharged into the space S in the waste ink tank 15 via the cap 12 and the tube 13.

Waste ink discharged into the space S is absorbed at the side faces 18*b*, 18*d* and the face 18*c* of the liquid absorber 18 that form the space S. At this time, air pressurized by the pump 14 is discharged into the space S via the tube 16. Accordingly, the waste ink absorbed by the liquid absorber 18 diffuses and permeates into the inside of the liquid absorber 18 driven by the pressure of the discharged air.

Note that the space S is formed by the recess portion 18*a* in the liquid absorber 18, the side wall 17*c* and the upper wall 17*b* of the liquid collection container 17, and is distanced from the third opening portion 17*a*. Accordingly, air discharged into the space S flows toward the third opening portion 17*a*. Waste ink diffuses and permeates also toward the third opening portion 17*a*. This means that waste ink can be made to permeate toward a region which is inherently hard to be permeated because of being distanced from the space S. That is to say, waste ink can be made to permeate into the entire liquid absorber 18.

After the cleaning of the recording head 9 is finished, and when the printer 1 is in a print-pausing state, a space formed by the nozzle-forming face 9*a* and the cap 12 is communicated with the air via the tube 13, the space S, and the tube 16. By doing so, even if an ambient temperature in the periphery of the maintenance mechanism 11, the printer 1, or the like changes to cause a rise in pressure and bring about expansion of the space in the cap 12, the change in pressure is reduced and breaking of a meniscus formed in each nozzle 9*b* of the recording head 9 is prevented from occurring.

Therefore, according to the first embodiment mentioned above, the following effects can be obtained.

1. In the above-mentioned first embodiment, the maintenance mechanism 11 as the liquid collection device discharges air into the liquid collection container 17 via the tube 16 by driving of the pump 14. Accordingly, unlike a case in which the tube 16 is not present and waste ink discharged into the liquid collection container 17 is absorbed by the liquid absorber 18 in an uncontrolled discharging state, a high pressure can be applied to the discharged waste ink so as to cause the waste ink discharged into the liquid collection container 17 to permeate into the inside of the liquid absorber 18.

2. In the above-mentioned first embodiment, the second connection portion 20 is disposed at a higher position than the first connection portion 19 in the gravitational direction. Therefore, there exists no risk such that waste ink discharged from the first connection portion 19 into the liquid collection container 17 mistakenly flows into the second connection portion 20 or into the tube 16 connected to the second connection portion 20.

3. In the first embodiment mentioned above, the space S is formed by part of the wall that constitutes the liquid collection container 17 including the first connection portion 19 and second connection portion 20, and by the liquid absorber 18; waste ink and air are discharged into this space S. Accordingly, in contrast to a case where the space S is not present, an area of the liquid absorber 18 to which the discharged waste ink attaches can be increased. In addition, since air is discharged into the space S from the tube 16, waste ink spreading in the space S can be made to permeate into the inside of the liquid absorber 18 using the discharged air.

Second Embodiment

Next, a second embodiment that specifies an embodiment according to the invention is described with reference to FIG. 4.

It is to be noted that in the following descriptions, for the sake of simplicity, elements that differ from the first embodiment are explained; elements identical to those in the first embodiment are given identical reference numerals and descriptions thereof will be omitted. As shown in FIG. 4, this embodiment is characterized in that the tube 13 as a liquid delivery tube and the tube 16 as a gas delivery tube in the first embodiment are inserted into the inside of the liquid collection container 17.

On the side wall 17*c* of the liquid collection container 17 according to this embodiment, the first projection portion 19*a* and the second projection portion 20*a* are formed in the same manner as in the first embodiment. Note that in this embodiment, the tube 13 passes through a hollow portion of the first projection portion 19*a* so as to be inserted into the inside of the liquid collection container 17, meanwhile the tube 16 passes through a hollow portion of the second projection portion 20*a* so as to be inserted into the inside of the liquid collection container 17. Thus, by inserting the tubes, the liquid collection container 17 and each of the tubes are connected.

Therefore, the first projection portion 19*a* becomes the first connection portion 19 and the second projection portion 20*a* becomes the second connection portion 20 in this embodiment the same as in the first embodiment. The inside diameter of the first projection portion 19*a* and the outside diameter of the tube 13 are nearly the same. The inside diameter of the second projection portion 20*a* and the outside diameter of the tube 16 are nearly the same. It is unfavorable for the liquid collection container 17 if there is a gap between the first projection portion 19*a* and the tube 13 or between the second projection portion 20*a* and the tube 16, because waste ink, air, or the like will leak out therefrom. If such a gap is present, it is desirable to include a member that fills or seals the gap.

The first projection portion 19*a* in this embodiment, as being different from the first embodiment, is formed on the side wall 17*c* of the liquid collection container 17 at a higher position than the second projection portion 20*a* in the gravitational direction (the vicinity of the upper end of the side wall 17*c*).

A liquid absorber 38 includes a recess portion 38*a* whose inside diameter is nearly the same as the outside diameter of the tube 13 and a recess portion 38*b* whose inside diameter is nearly the same as the outside diameter of tube 16. The tube 13 is inserted into the recess portion 38*a* and the tube 16 is inserted into the recess portion 38*b*, whereby they are inserted into the inside of the liquid absorber 38.

In the second embodiment, an opening portion 13*d* of the tube 13 is a waste ink discharge portion (liquid discharge portion) and the recess portion 38*a* is an ink receiving face (ink receiver). Further, an opening portion 16*d* of the tube 16 is an air discharge portion (gas discharge portion).

In this embodiment, the recess portion 38*a* as a first insert portion and the recess portion 38*b* as a second insert portion are formed so that the opening portion 13*d* of the tube 13 is disposed at a higher position than the opening portion 16*d* of the tube 16 in the gravitational direction. Further, the recess portion 38*a* and recess portion 38*b* are positioned at the right side of the liquid absorber 38 in the right-left direction. Waste ink discharged toward the liquid absorber 38 via the tube 13 permeates mainly into the lower side in the gravitational direction through the opening portion 13*d*. Part of the waste ink permeates also to the right-left direction due to the discharge pressure, an inherent permeation capability, and the like. However, the permeation to the right-left direction is unlikely to take place in comparison with the permeation into the gravitational direction. Accordingly, in FIG. 4, waste ink is likely to accumulate at the right side in the right-left direction and at the lower side in the upward-downward direction.

However, in this embodiment, because the opening portion 16*d* of the tube 16 is disposed at a lower position than the opening portion 13*d* of the tube 13 in the gravitational direction, air pressure can be applied to the waste ink, which is likely to accumulate at the lower side, from the lower side to the direction of the third opening portion 17*a*.

Accordingly, it is possible to cause the waste ink discharged into the liquid absorber 38 to permeate into the entire liquid absorber 38.

Therefore, according to the second embodiment described above, the following effects can be obtained.

4. In the second embodiment described above, the opening portion 13*d* of the tube 13 is disposed at a higher position than the opening portion 16*d* of the tube 16 in the gravitational direction. This makes it possible to apply air pressure to waste ink that is discharged through the tube 13 to move downward in the liquid absorber 38 in the gravitational direction so that the waste ink permeates into the horizontal direction in the liquid absorber 38. Therefore, it is possible to cause the waste ink discharged into the liquid absorber 38 to permeate into the entire liquid absorber 38.

Although the sizes of the tube 13 and the recess portion 38*a* are made nearly the same and the sizes of the tube 16 and the recess portion 38*b* are also made nearly the same, each size of the recess portions may be larger than each corresponding size of the tubes.

Figure 5:
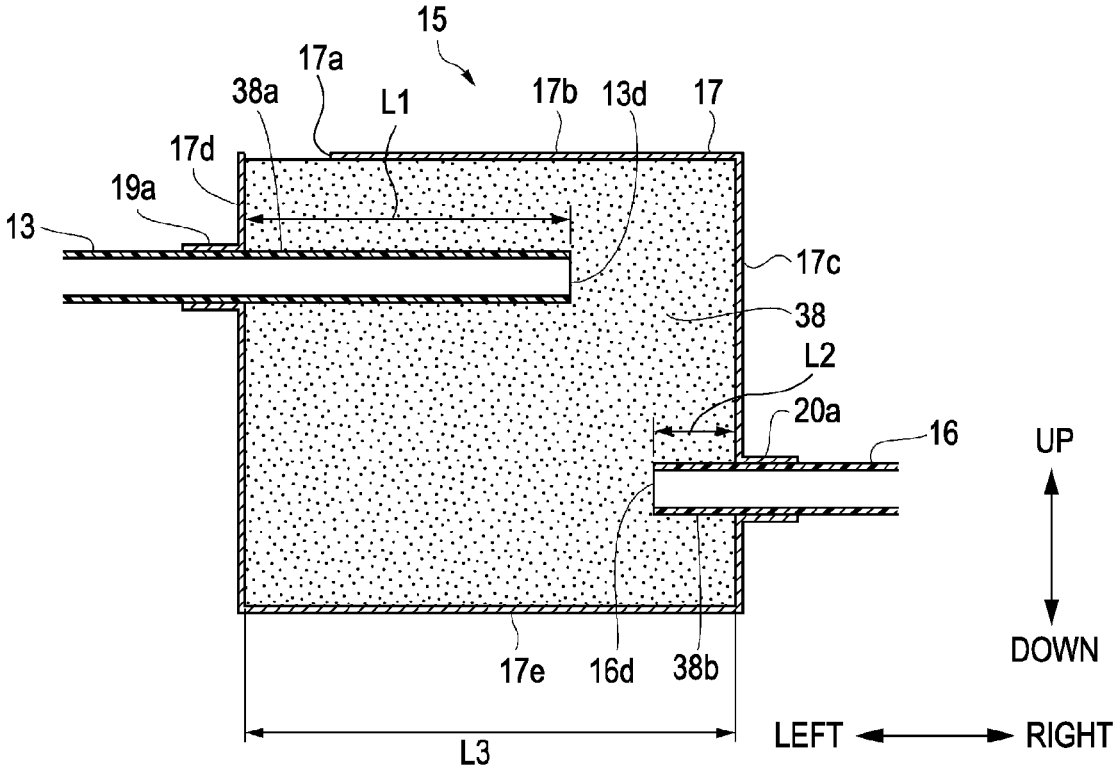
FIG. 5 is a cross-sectional view of a waste ink tank of a variation.

The same effect also can be obtained with a configuration shown in FIG. 5 according to the second embodiment.

Figure 4:
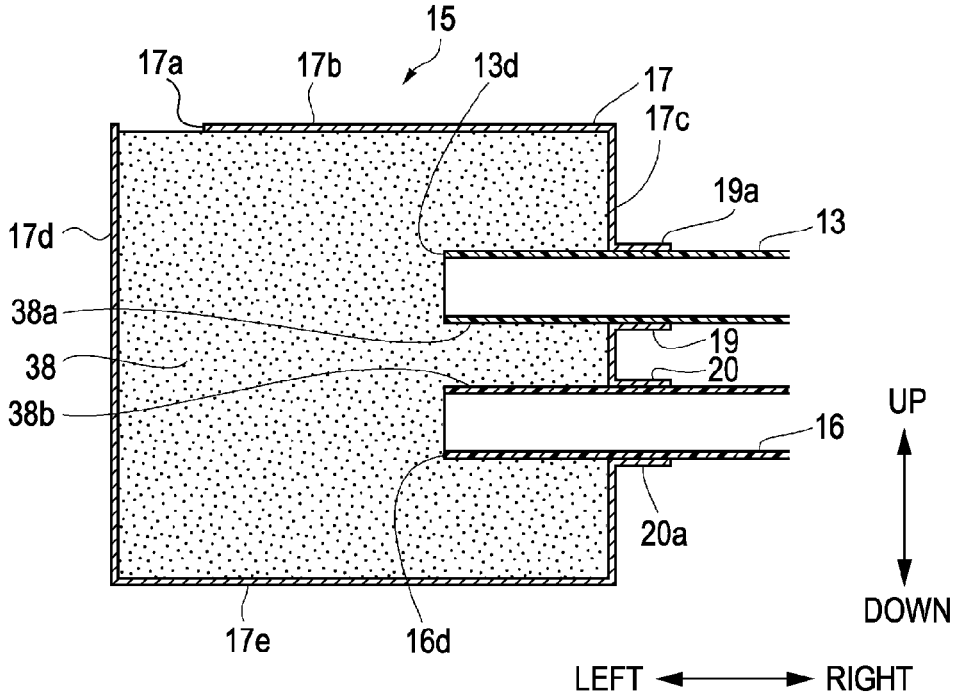
FIG. 4 is a cross-sectional view of a waste ink tank according to a second embodiment of the invention.

Comparing FIG. 5 with FIG. 4, the positional relationship between the second projection portion 20*a*, the tube 16 and the third opening portion 17*a* is the same, however, the positional relationship between the first projection portion 19*a*, the tube 13 and the third opening portion 17*a* is different in FIG. 4 and FIG. 5. In FIG. 5, the first projection portion 19*a* is provided on the side wall 17*d* opposite to the side wall 17*c* having the second projection portion 20*a*. The first projection portion 19*a* is formed at a side closer to the third opening portion 17*a* on the side wall 17*d*. The tube 13 is inserted into the inside of the first projection portion 19*a*. The opening portion 13*d*, which is a tip portion of the tube 13, is distanced from the third opening portion 17*a* in the right-left direction. A portion of the tube 13 inserted into the liquid absorber 38 in FIG. 5 is longer than that of the tube 13 in FIG. 4.

In the configuration illustrated in FIG. 5, a positional relationship between the elements to provide a place to which waste ink is discharged is similar to that in FIG. 4. That is to say, the opening portion 13*d* is placed at a higher position than the opening portion 16*d* in the upward-downward direction, placed on the right side in the right-left direction, and distanced from the third opening portion 17*a* in the right-left direction. Further, the opening portion 13*d* and opening portion 16*d* have a positional relationship in which they are close to each other in the right-left direction.

With such positional relationship, waste ink discharged through the opening portion 13*d* mainly permeates downward in the gravitational direction, then permeates toward the third opening portion 17*a* due to pressure of air from the opening portion 16*d*, whereby the waste ink permeates into the entire liquid absorber 38.

Here, assume that the length of a portion of the tube 13 inserted into the liquid collection container 17 (horizontal distance from the inner side of the side wall 17*d* to the opening portion 13*d*) is L1; the length of a portion of the tube 16 inserted into the liquid collection container 17 (horizontal distance from the inner side of the side wall 17*c* to the opening portion 16*d*) is L2; and the horizontal distance from the inner side of the side wall 17*d* to the inner side of the side wall 17*c* is L3.

If L1 is equal to or more than two thirds of L3 and is less than L3, the opening portion 13*d* is positioned being distanced from the third opening portion 17*a* in the right-left direction. Furthermore, if (L1+L2) is less than L3, the opening portion 13*d* is positioned to the left of the opening portion 16*d*.

Here, the spirit of the invention is described. In the aforementioned embodiments according to the invention, ink (liquid) is made to permeate into every corner of the liquid absorbers 18, 38 in the waste ink tank 15 by discharging a gas to the waste ink tank 15 to cause a rise in pressure, whereas under the past technique, waste ink was required to permeate into the liquid absorbers 18, 38 in the waste ink tank 15 by an inherent permeation capability.

At this time, the liquid discharge portions 19*b*, 13*d* and the gas discharge portions 20*b*, 16*d* are provided separately. Pressure of liquid is applied to the liquid itself when the liquid is discharged even in a configuration of the past technique. However, the liquid does not permeate sufficiently into the absorber only by the pressure of the discharged liquid. Therefore, a higher pressure produced by gas is applied to the liquid so as to facilitate the permeation. By providing the liquid discharge portions 19*b*, 13*d* and the gas discharge portions 20*b*, 16*d* separately, it is possible to apply a necessary pressure to the liquid.

The waste ink tank 15 of the embodiments includes the liquid absorbers 18, 38 and the liquid collection container 17 that holds the liquid absorbers 13, 38. The third opening portion 17*a* is provided in the liquid collection container 17, and the third opening portion 17*a* exposes the liquid absorbers 18, 38 in a state in which they can be seen from outside. With respect to the third opening portion 17*a*, the liquid discharge portions 19*b*, 13*d* and the gas discharge portions 20*b*, 16*d* are disposed at one end side and at the other end side, respectively, in the horizontal direction. In other words, the third opening portion 17*a* is distanced from the liquid discharge portions 19*b*, 13*d* and the gas discharge portions 20*b*, 16*d* in the horizontal direction.

Any opening portion other than the third opening portion 17*a* does not exist in the liquid collection container 17. Accordingly, discharged gas flows toward the third opening portion 17*a*, and liquid also flows toward the third opening portion 17*a* driven by the flowing gas. Due to this effect, liquid can permeate in the horizontal direction, to which permeation is unlikely to take place, and consequently permeates into the entire liquid absorbers 18, 38.

The gas discharge portions 20*b*, 16*d* are positioned so that gas flows in a direction to which liquid is unlikely to permeate. If the liquid discharge portions 19*b*, 13*d* are disposed at one end side in the horizontal direction, it is desirable that the gas discharge portions 20*b*, 16*d* are also disposed at the same side, and the third opening portion 17*a* is disposed at the other end side.

Positional relationships in the upward-downward direction between the liquid discharge portions 19*b*, 13*d* and the gas discharge portions 20*b*, 16*d* are determined depending upon the recess portions 18*a*, 38*a*, 38*b*. In the case where only one recess portion, i.e., the recess portion 18*a* is present, liquid is widely received at areas such as the side faces 18*b*, 18*d* and the face 18*c* of the recess portion 18*a*. When gas is discharged into the recess portion 18*a*, pressure of the gas is applied to the waste ink which has been widely received so that the ink is likely to permeate into the entire liquid absorber. In this case, the same effect can be obtained as long as the gas discharge portion 20*b* is positioned within the recess portion 18*a*. In the case where two recess portions, i.e., the recess portions 38*a*, 38*b* are present, the pressure of gas cannot effectively act on the recess portion 38*a* that receives liquid. Therefore, the gas discharge portion 16*d* is disposed at a lower position than the liquid discharge portion 13*d* so that the pressure can be applied to the ink that has permeated to the lower side from the recess portion 38*a* along the gravitational direction.

Variations

Figure 6:
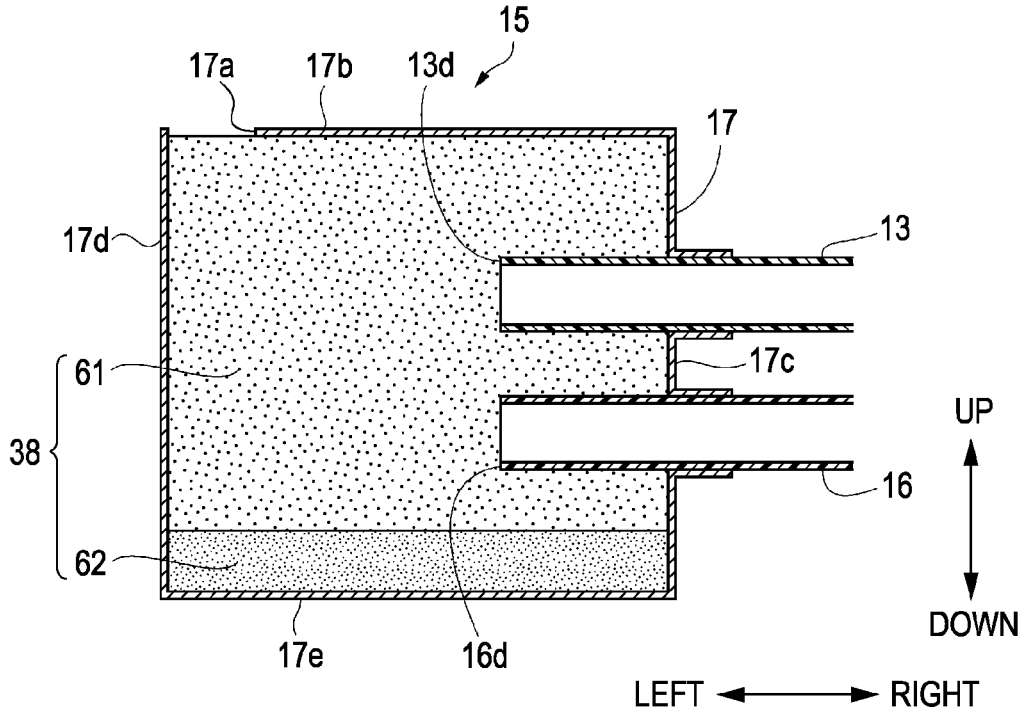
FIG. 6 is a cross-sectional view of a variation of a waste ink tank.

Next, variations on the first and second embodiments will be described based on FIG. 6.

Note that in the following descriptions, for the sake of simplicity, elements that differ from the first and second embodiments will be explained; elements identical to those in the first and second embodiments are given identical reference numerals and descriptions thereof will be omitted. As shown in FIG. 6, this embodiment is characterized in that the liquid absorber 38 according to the aforementioned embodiments includes a multilayer in which a plurality of porous materials are laminated in the gravitational direction.

In this embodiment, the liquid absorber 38 includes a first absorber 61 placed on the upper side and a second absorber 62 placed on the lower side. Further, the tube 13 and the tube 16 are inserted into the first absorber 61.

The first absorber 61 is formed of a porous material with pores having a larger diameter (lower density) compared to the second absorber 62. The retention capacity of liquid of a porous material becomes larger as the diameter of pores becomes smaller (higher density), whereas it becomes smaller as the diameter of pores becomes larger (lower density). Further, in the case where gas is discharged into a porous material, the gas circulates more easily in the porous material as the diameter of pores becomes larger (lower density). Therefore, the first absorber 61 is more likely to allow discharged ink and air to permeate and circulate therein than the second absorber 62. Note that the second absorber 62 is thinner in thickness and smaller in volume than the first absorber 61.

With such configuration, due to difference in the amount of gas circulation which is brought by the difference in porous material density, air discharged from the tube 16 is unlikely to flow in the second absorber 62 of high density, and preferentially flows in the first absorber 61 of low density. Accordingly, waste ink discharged from the tube 13 and absorbed in the first absorber 61 is applied a permeation pressure by the air discharged from the tube 16, then permeates into the entire liquid absorber 61. With this, it is prevented for waste ink to stay stagnantly in the periphery of the opening portion 13*d* of the tube 13 in the first absorber 61; as a result, clogging in the first absorber 61 due to solidification of ink in the periphery of the opening portion 13*d* can be suppressed. In addition, by disposing the second absorber 62, which is thinner than the first absorber 61, below the first absorber 61, waste ink that has spread across the entire first absorber 61 can be received. Since the second absorber 62 is on the lower side, waste ink is made to move from the first absorber 61 due to gravity and holding capability. Further, by making the second absorber 62 to be thin, it is also suppressed that the permeation of waste ink stops halfway to the bottom.

In the first embodiment, the space S is formed by the recess portion 18*a* in the liquid absorber 18, and the side wall 17*c* and the upper wall 17*b* of the liquid collection container 17. As shown in FIG. 7, the recess portion 18*a*' is formed in a manner in which the liquid absorber 18 covers the upper side of the space S in the gravitational direction, and the space S may be formed by the recess portion 18*a*' and the side wall 17*c*. With this configuration, even if waste ink discharged into the space S splashes to the side of the upper wall 17*b*, the waste ink can be absorbed by the liquid absorber 18 placed at the upper side of the space S in the gravitational direction.

Figure 8:
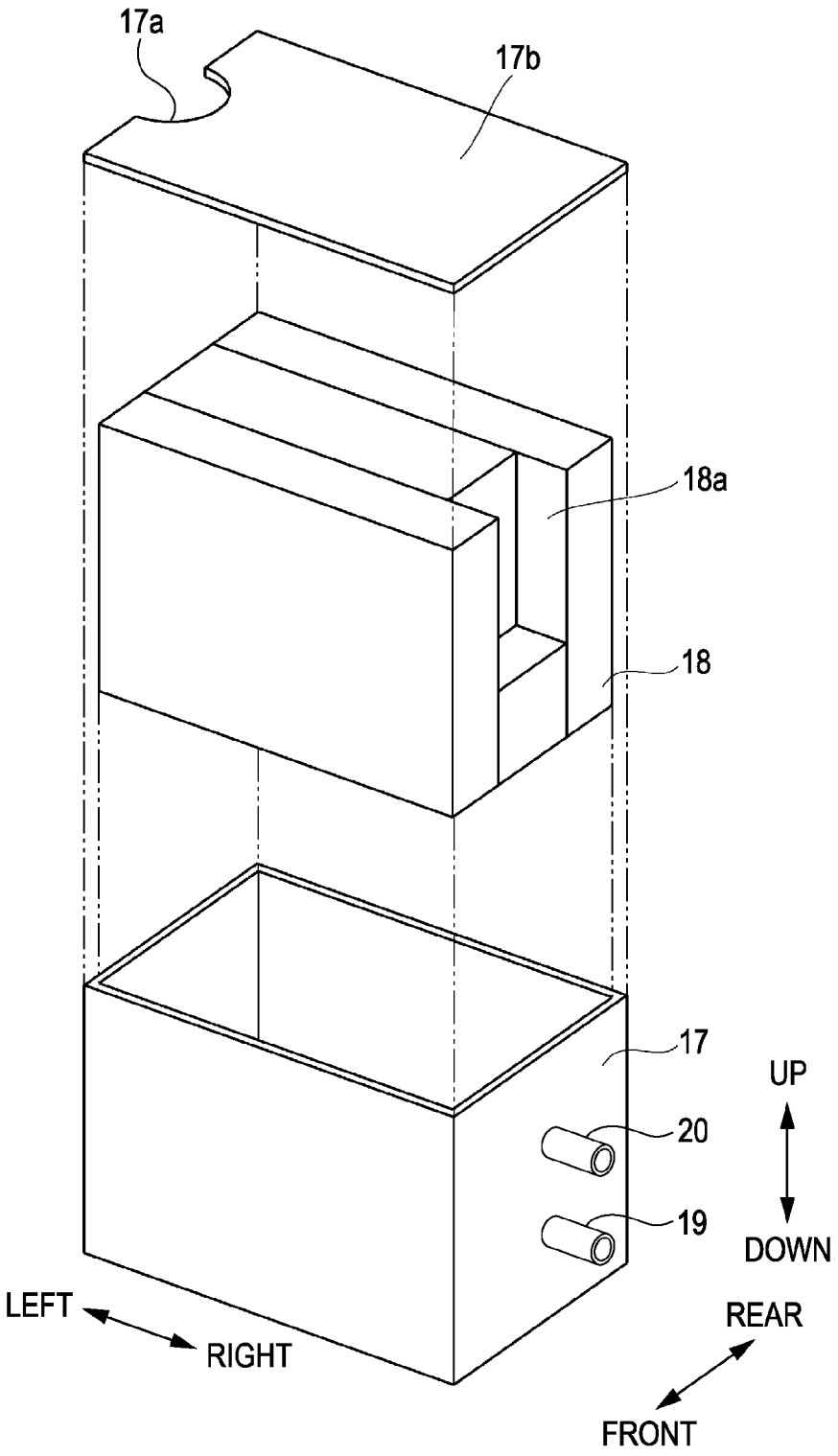
FIG. 8 is an exploded perspective view of a variation of a waste ink tank.

Furthermore, as shown in FIG. 8, in the first embodiment, the liquid absorber 18 may be divided into several segments so that boundary surfaces exist in the gravitational direction, and be accommodated in the liquid collection container 17. It is to be noted that the shape of the third opening portion 17*a* is not limited to a quadrangle, and may be a semicircle as illustrated in FIG. 8. The shape of the third opening portion 17*a* is not limited as long as the opening can facilitate the evaporation of waste ink.

Figure 9:
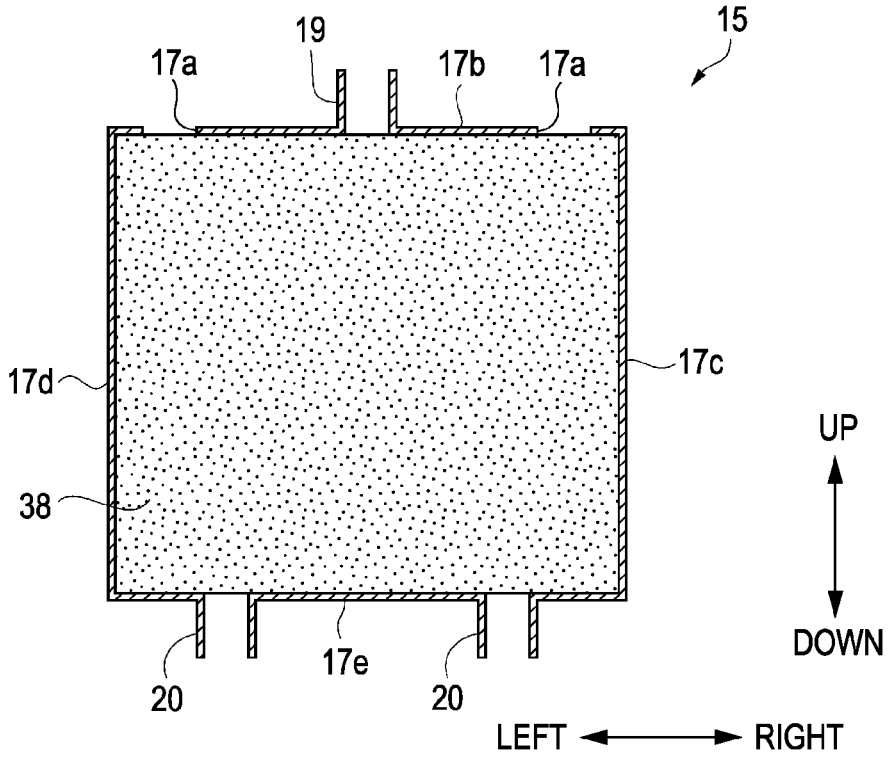
FIG. 9 is a cross-sectional view of a variation of a waste ink tank.

Further, in the second embodiment, the first connection portion 19 and the second connection portion 20 are formed on the side wall 17*c* or the side wall 17*d* of the liquid collection container 17. However, as shown in FIG. 9, the first connection portion 19 may be formed near the center portion of the upper wall 17*b* positioned at the upper side of the liquid collection container 17 in the gravitational direction; meanwhile, two second connection portions 20 may be formed on the bottom wall 17*e* positioned at the lower side of the liquid collection container 17 in the gravitational direction, in which one is on the side of the side wall 17*c* and the other is on the side of the side wall 17*d*. With this, a permeation pressure, produced by gas which is discharged from the second connection portions 20 side, can be applied to waste ink that was discharged from the first connection portion 19 side, started permeating downward in the liquid absorber 38 due to gravity, and has permeated down to the periphery of the bottom wall 17*e*, so that the waste ink can permeate into the upper side of the liquid absorber 38 in the gravitational direction.

Accordingly, unlike a case of a so-called uncontrolled discharging state in which the second connection portion 20 is not provided, ink can be made to permeate into regions of the liquid absorber 38 near the upper wall 17*b*, while one of the regions of the liquid absorber 38 is on the side of the side wall 17*c* near the upper wall 17*b* with respect to the first connection portion 19, and the other one is on the side of the side wall 17*d* near the upper wall 17*b* with respect to the first connection portion 19. Furthermore, in FIG. 9, the second connection portions 20 may not be provided on the bottom wall 17*e*, and may be provided in the lower portions of the side walls 17*c* and 17*d*, respectively. Note that the tubes 13, 16, and the recess portions 38*a*, 38*b* are omitted in FIG. 9.

In the aforementioned embodiments, when waste ink and air are sucked and delivered via the tube 13 and the tube 16, the identical pump 14 is used. However, different pumps may be provided for each of the tubes to carry out suction and delivery of liquid and gas. In this case, a pump for liquid delivery and a pump for gas delivery will be provided.

In this embodiment, a set of the pump 14 and the tube 16 for gas delivery is called a gas delivery unit. In the case where the identical pump 14 is used, the pump 14 in a liquid delivery unit is also the pump 14 in the gas delivery unit. By separately providing a pump for gas delivery and a pump for liquid delivery, suction force, delivery force, and the like can be adjusted for every liquid and every gas.

In the aforementioned embodiments, although the tubes 13 and 16 are drawn in the same diameter, the diameter of the tubes is not limited thereto. Because waste ink is spread across the entire liquid absorber by the pressure of air discharged from the tube 16, it is desirable that the pressure of air from the tube 16 is larger than the discharge pressure of waste ink from the tube 13. With this reason, in the case where the identical pump 14 is used, the diameter of the tube 16 may be larger than that of the tube 13. In the case where different pumps are used, the pressure of a pump for air delivery is larger than that of a pump for liquid delivery.

In the aforementioned embodiments, suction and delivery of ink may be carried out using a plurality of tubes 13. This makes it possible to increase the amount of ink suction and delivery in comparison with a case in which a single tube 13 is provided. Similarly, suction and delivery of gas may be carried out using a plurality of tubes 16. If a region that prevents ink from permeating into the entire liquid absorber exists, it is desirable for the tube 16 to be disposed so that the pressure acts toward the region into which the ink is unlikely to permeate.

Figure 10:
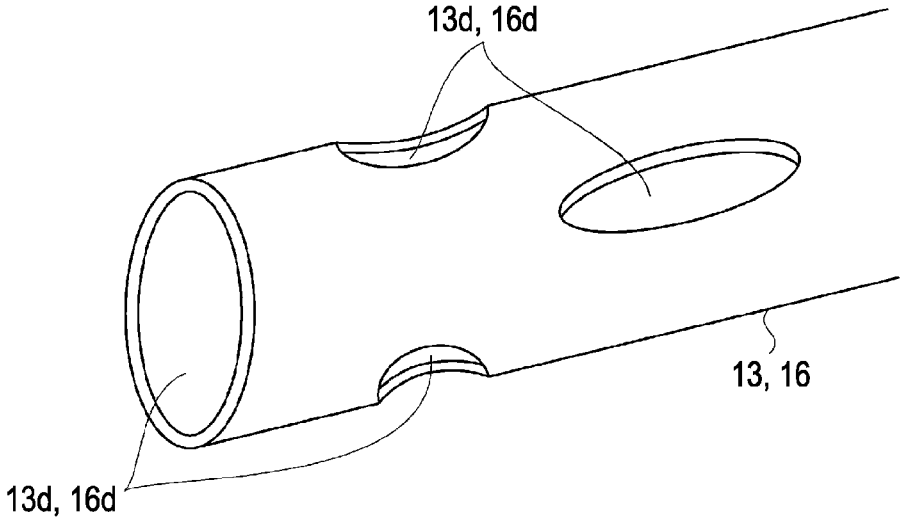
FIG. 10 is a perspective view of a variation of a tube.

In the aforementioned embodiments, although the tube 13 has the opening portion 13*d* at an end portion thereof, the portion at which the opening portion 13*d* is provided is not limited thereto. Similarly, although the tube 16 has the opening portion 16*d* at an end portion thereof, the portion at which the opening portion 16*d* is provided is not limited thereto. For example, as illustrated in FIG. 10, the opening portions 13*d* or the opening portions 16*d* may be provided on the side face of the tube 13 or tube 16. This makes it possible to change a waste ink discharge direction or a gas discharge direction to various directions. Accordingly, waste ink can be made to permeate into the entire liquid absorber with ease.

In the aforementioned embodiments, although the pump 14 includes a tube pump, the invention is not limited thereto. For example, a gear pump, piston pump, diaphragm pump, or the like can be appropriately selected as long as each of them can carry out suction and delivery of liquid, gas, and the like.

Further, in the aforementioned embodiments, one end side (upstream side) of the tube 16 is exposed to the air, and air inhaled therefrom is delivered. However, it is desirable that a gas supply chamber is provided separately and a gas is delivered via the tube 16 connected to the gas supply chamber. For example, in the case where aqueous ink is used as liquid, solidification of ink components occurs due to evaporation of moisture which is a solvent component of ink. Therefore, by delivering a gas that contains a lot more moisture vapor than the ordinal air, solidification of ink can be suppressed.

Components of ink will change in quality and solidify due to oxygen or the like in the air. So, in order to suppress the solidification of ink components, an inert gas such as nitrogen gas, argon gas, or helium gas may be used as a gas to be discharged. The inert gas is unlikely to cause a chemical reaction to occur. In addition, with regard to ink used by a ultraviolet light irradiation-type printer in which ink is hardened by irradiation of ultraviolet light to carry out printing, solvent components of ink can be suppressed from evaporation by making the amount of oxygen present in the periphery be larger than the amount of oxygen contained in the ordinary air. Therefore, when such ink is used for printing, a gas that contains a larger amount of oxygen than the ordinary air may be employed.

In the above embodiments including the variations, the ink jet printer 1 is employed as one type of liquid ejecting apparatus. However, a liquid ejecting apparatus that ejects and discharges liquid other than ink may be employed. For example, the invention can be applied to various types of liquid ejecting apparatuses having a liquid ejecting head that discharges a trace amount of liquid droplets, and the like. In this case, the terminology "liquid droplets" represents a state of liquid which is discharged from the above liquid ejecting apparatus. A granule form, a teardrop form, and a form that pulls a tail in a string-like form therebehind are included as the liquid droplets.

The terminology "liquid" here represents materials that can be ejected by the liquid ejecting apparatus. Any materials are included as long as they are in a liquid phase. For example, materials in a liquid state having high viscosity or low viscosity, or a fluid state such as sol, gel water, other inorganic solvents, an organic solvent, a solution, a liquid resin or a liquid metal (molten metal) can be included as the liquid. Further, the liquid is not limited to liquid as one state of material, and includes a solution in which particles of functional materials made of solid materials such as pigment and metal particles are dissolved, dispersed, or mixed in a solvent.

Typical examples of liquid are ink described in the above embodiments, liquid crystals, and the like. The term "ink" here encompasses various liquid compositions such as common aqueous ink, oil-based ink, gel ink, hot melt ink and so on.

Specific examples of the liquid ejecting apparatus include a liquid ejecting apparatus that ejects liquid in which a material such as an electrode material or a coloring material is dispersed or dissolved. The material such as the electrode material or the coloring material is used for manufacturing liquid crystal displays, electroluminescence (EL) displays, surface light emitting displays and color filters, for example. Further, the specific examples of the liquid ejecting apparatus include a liquid ejecting apparatus that ejects a bioorganic material used for manufacturing biochips, a liquid ejecting apparatus that ejects a liquid serving as a sample and is used as a precision pipette, printing equipment, and a micro-dispenser. Further, other examples of the liquid ejecting apparatus include a liquid ejecting apparatus that pinpoint-ejects lubricating oil to a precision machine such as a watch or camera; a liquid ejecting apparatus that ejects a transparent resin solution of an ultraviolet curable resin or the like onto a substrate in order to form a miniature hemispheric lens (optical lens) used for an optical communication element and the like; and a liquid ejecting apparatus that ejects an acid or alkali etching solution for etching a substrate or the like. The invention can be applied to any one type of the liquid ejecting apparatuses mentioned above.

The entire disclosure of Japanese Patent Application No. 2010-187958, filed Aug. 25, 2010, and 2011-130981, filed Jun. 13, 2011 are expressly incorporated by reference herein.

What is claimed is:

1. A liquid collection device comprising:

a liquid ejecting head that ejects liquid;

a suction-delivery unit that sucks the liquid from the liquid ejecting head and delivers the sucked liquid;

a liquid collection unit that collects the liquid delivered from the suction-delivery unit; and a gas delivery unit that delivers gas into the liquid collection unit, wherein the liquid collection unit includes a first connection portion that connects with the suction-delivery unit and a second connection portion that connects with the gas delivery unit.

2. The liquid collection device according to claim 1, wherein the liquid collection unit includes a liquid absorber that absorbs the liquid and a liquid collection container that holds the liquid absorber;

the liquid collection container includes the first connection portion, the second connection portion, and an opening portion that exposes the liquid absorber; and wherein a liquid discharge portion that discharges the liquid into the liquid collection unit and a gas discharge portion that discharges the gas into the liquid collection unit are disposed at one end side in the horizontal direction of the liquid collection unit, whereas the opening portion is disposed at the other end side in the horizontal direction of the liquid collection unit.

3. The liquid collection device according to claim 2, wherein the liquid collection unit includes a space portion formed by the liquid collection container and the liquid absorber, the liquid is discharged from the liquid discharge portion into the space portion, and the gas is discharged from the gas discharge portion into the space portion.

4. The liquid collection device according to claim 3, wherein the space portion is configured of one single space.

5. A liquid ejecting apparatus comprising the liquid collection device according to claim 4.

6. The liquid collection device according to claim 3, wherein the space portion is formed respectively corresponding to the liquid discharge portion and the gas discharge portion, and the gas discharge portion is disposed at a lower position than the liquid discharge portion in the gravitational direction.

7. A liquid ejecting apparatus comprising the liquid collection device according to claim 6.

8. A liquid ejecting apparatus comprising the liquid collection device according to claim 3.

9. A liquid ejecting apparatus comprising the liquid collection device according to claim 2.

10. A liquid ejecting apparatus comprising the liquid collection device according to claim 1.

* * * * *